United States Patent [19]

Floyd

[11] 4,143,531

[45] Mar. 13, 1979

[54] DISPOSABLE CORE FOR LOCK CYLINDER

[75] Inventor: Alfred E. Floyd, North Guilford, Conn.

[73] Assignee: Walter Kidde & Company, Inc., Clifton, N.J.

[21] Appl. No.: 865,227

[22] Filed: Dec. 28, 1977

[51] Int. Cl.[2] ..... E05B 15/00

[52] U.S. Cl. ..... 70/367

[58] Field of Search ..... 70/369, 367, 368, 382, 70/385

[56] References Cited

U.S. PATENT DOCUMENTS 3,715,899 2/1973 McCullum ..... 70/369

*Primary Examiner*—Robert L. Wolfe

*Attorney, Agent, or Firm*—DeLio and Montgomery

[57] ABSTRACT

A disposable plug assembly to be used as a substitute for the removable core in a lock cylinder, as during the construction of a building, prior to installation of the final cores, the disposable core including a part which can be used to operate a cam or tail on the cylinder for actuating a latch bolt.

8 Claims, 11 Drawing Figures

DISPOSABLE CORE FOR LOCK CYLINDER

This invention relates to a disposable plug assembly for use in a lock cylinder, as a substitute for the key-operated core to be subsequently installed, particularly in interior, non-critical, doors of a building under construction.

Removable core cylinders are well-known and are adapted for use with mortise locks, exit device locks, deadlocks, padlocks and other types of locksets. The removable core unit is normally of "figure 8" cross-sectional form, comprising two overlapping cylindrical portions, one containing the keyway and the other containing the pins. The keyway portion is engageable with a latch-actuating device, such as a cam or tail, on the rear of the cylinder and the core unit is secured in the cylinder by a locking lug requiring a special control key. By releasing the lug, any core unit can be removed and replaced in order to set up a system of locksets having any desired arrangement of individual and master key responsiveness.

A removable "construction core" system protects the security of the owner's master key system during the period of construction when some or many persons have access to the interior of a building, such as an office building, hotel or other multi-room building having locks on interior doors. Such a system is in use throughout the construction period, the construction cores being used in place of the permanent master-keyed cores. This prevents the keys to the permanent system from becoming available to unauthorized persons. Upon completion of the building, the temporary construction cores are removed and replaced by permanent cores and all keys for the construction system become inoperative.

Difficulties have been encountered in effecting the complete replacement of construction cores, at substantially the same time, as can be appreciated from the fact that a large building may have scores of locking doors, such that accurate records must be made of all replacements, core inventories checked and all old and new keys accounted for.

It is accordingly an object of the present invention to provide a disposable core or plug which can be used during the course of construction in lieu of the customary construction core and which can be removed and discarded when the permanent core is installed.

It is another object of the invention to provide a disposable core or plug which includes a portion adapted for actuation of the latch bolt by means of a key or key-like device, as may be needed during construction.

It is a further object of the invention to provide a disposable core or plug which can be installed and removed without the use of tools.

It is yet another object of the invention to provide certain improvements in the form, construction, arrangement and material of the disposable core elements whereby the above-named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention and its manner of use are shown in the accompanying drawing, wherein.

Figure 1:
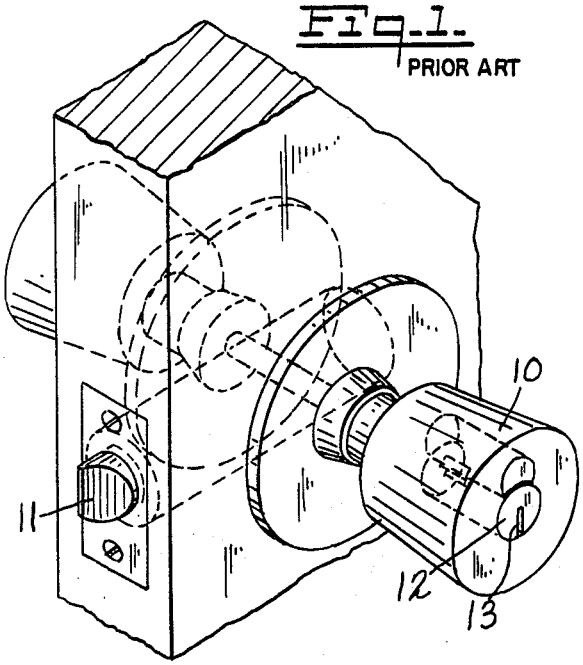
Fig. 1. PRIOR ART
FIG. 1 is a perspective view of a portion of a door provided with a knob-actuated bored lock having a removable core cylinder in one knob.

Referring to the drawing, FIGS. 1 to 5 and 11 illustrate known mechanisms, being shown here in order to establish the environment wherein the new disposable plug assemblies have demonstrated their utility.

Figure 2:
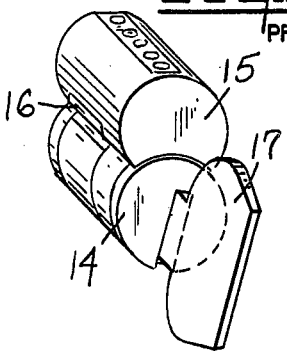
Fig. 2. PRIOR ART
FIG. 2 is a perspective view of the removable core, with key, in condition for removal or insertion of the core.
Figure 3:
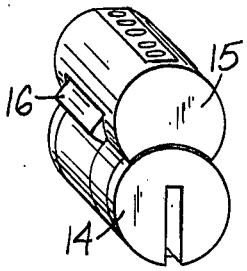
Fig. 3. PRIOR ART
FIG. 3 is a view like FIG. 2 showing the core-retaining lug in projected position and the key removed.
Figure 4:
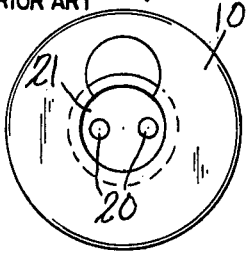
Fig. 4. PRIOR ART
FIG. 4 is an elevation of the face of the doorknob with the core removed.
Figure 5:
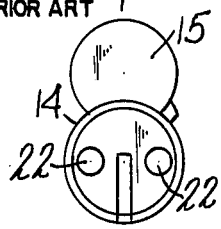
Fig. 5 PRIOR ART
FIG. 5 is an inner-end view of the removable core.
Figure 9:
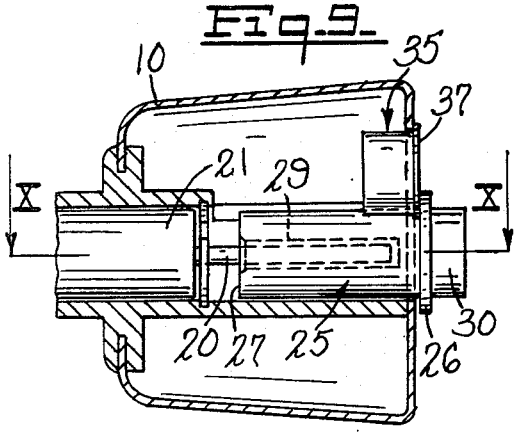
FIG. 9 is a vertical axial section through a knob equipped with the removable plug units.
Figure 6:
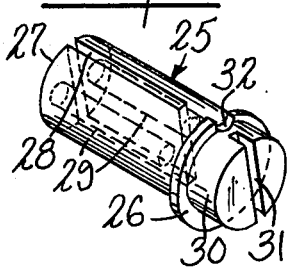
FIG. 6 is a perspective view of the disposable plug main unit.
Figure 7:
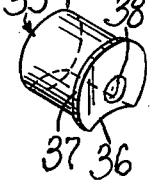
FIG. 7 is a perspective view of the disposable plug auxiliary unit.

In FIG. 1, the knob 10 actuates the latch bolt 11 in a customary manner and can be locked by a lockset which includes the removable core 12 having a keyway 13. The core (FIGS. 2 to 5) is of "figure 8" cross-sectional form and includes the keyway housing 14 and the pin housing 15. At the junction between these housings, the unit is provided with a locking lug 16 which can be moved into and out of core locking position only by means of a control key 17. When the lug is projected, as shown in FIG. 3, it engages with a correspondingly shaped recess in the lock cylinder, retaining the core for operation in a normal manner by an appropriate service key or master key. For removal of the core, the control key is used to withdraw the lug, as shown in FIG. 2.

The service key actuates the latch bolt by the engagement of the key cylinder with a pair of axially directed pins 20 (FIG. 4) mounted on rotatable disc 21 in the inner end of the cylinder, which disc is provided with a cam, tail or other means for engaging the latch bolt mechanism. The key cylinder is provided with holes 22 in which the pins 20 are engaged. Thus rotation of the key cylinder by means of a suitably bitted key will actuate the latch bolt.

According to the present invention, the core 12, 14, 15 is replaced, during the building construction, by a two-part disposable plug assembly shown in FIGS. 6 to 10. The main part of this assembly comprises a cylindrical plug 25 having an integral annular collar 26 near its outer end and being slotted axially and diametrically from its inner end 27 to the vicinity of the collar, the slot 28 providing resiliency to facilitate use with locksets having slightly varying dimensions (within manufacturing tolerances). Each half of the slotted plug is provided with a hole 29, corresponding to the holes 22, sized and spaced to receive the pins 20 of the lock in which the core is to be used. The portion 30 of the plug 25, projecting forwardly from the collar 26, is provided with a diametrically disposed kerf 31. The collar 26 is notched at 32 in a position which is a few degrees (e.g. 5°) out of line with the axis of the kerf, for a purpose explained below.

Figure 8:
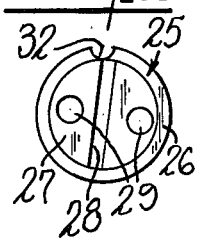
FIG. 8 is an inner-end view of the disposable plug main unit.
Figure 11:
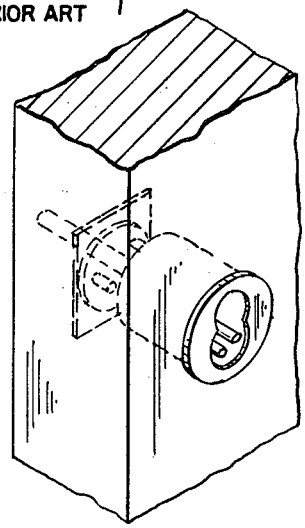
Fig. 11. PRIOR ART
FIG. 11 is a phantom perspective view of a portion of a door with a rim-type removable core cylinder therein.
Figure 10:
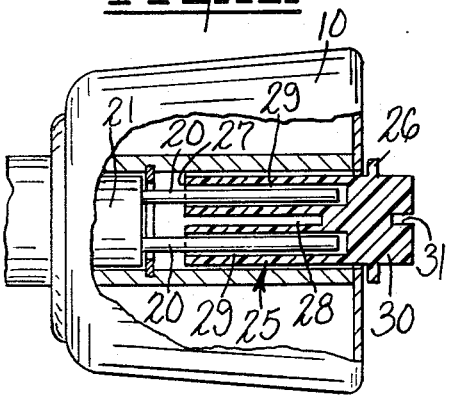
FIG. 10 is a horizontal section on the line X—X of FIG. 9.

Since the body 25 only occupies the lower portion of the "figure-8" shaped opening in the lock cylinder, a filler plug 35 is provided, this being in the form of a short cylinder, cut away at 36 on an arc corresponding to the surface of the plug 25, and having a small flange 37 and a centrally located dimple 38. It is sized to fit freely in the upper portion of the opening in the cylinder.

The disposable core portions 25, 35 may suitably be made of strong rigid plastic material.

In use, locksets of any appropriate type are installed in the doors of the building under construction, and each is equipped with the plastic "construction plugs" described above, assembled by inserting each top plug 35 into the upper portion of each cylinder opening followed by inserting each lower plug 25, with notch 32 aligned with dimple 38 and the holes 29 fitted on pins 20. The flange 37 on the upper plug limits its inward movement and the collar 26 overlies the surface of plug 35 and limits the inward movement of plug 25. Since the main plug 25 is engaged securely on the pins 20, rotation of the plug in any manner will actuate the lock, and such rotation can be easily effected by any tool or other device which can fit in the kerf 31, such as the end of a screw driver, a coin or the head of a flat key.

To remove the disposable construction plugs from an assembled and installed lockset, the outside knobs should be locked, by an inside knob push or turn button or by actuation of the plug 25. The bottom plug 25 should be rotated until notch 32 is aligned with dimple 38 (to assure proper alignment of the pins 20) and the plugs 25 and 35 are pulled out, in that order. A working core unit can then be inserted and locked into place by means of a control key, with the assurance that no one has had access, during construction, to such core unit or its keys.

It may thus be seen that the objects of the invention set forth, as well as those made apparent from the preceding description are efficiently attained and, since certain changes may be made in the aboe construction without departing from the spirit and scope of the invention, it is intended that all matter contained in the above description or shown in the accompanying drawing shall be interpreted as illustrative and not in a limiting sense.

What I claim is:

1. A disposable plug assembly for use in place of the core of a removable core lockset having a figure-8 shaped core cylinder cavity and latch actuating core engaging means in the lower portion of said cavity, the plug assembly comprising a main plastic cylindrical element having inner and outer ends and adapted to have a friction fit in said lower portion, said element having its inner end shaped to engage the core engaging means, and its outer end being solid and provided with means for engagement by an operating device for rotation of said element and actuation of a latch.

2. A disposable plug assembly according to claim 1 wherein said main cylindrical element is axially and diametrically slotted from its inner end toward its solid outer end.

3. A disposable plug assembly according to claim 1 wherein the core engaging means are axially extending parallel pins and the main cylindrical element is provided with holes to receive said pins.

4. A disposable plug assembly according to claim 2 wherein the core engaging means are axially extending parallel pins and the main cylindrical element is provided with holes on each side of the axial slot to receive said pins.

5. A disposable plug assembly according to claim 1 wherein said main cylindrical element is provided with an annular collar near its outer end.

6. A disposable plug assembly according to claim 5 wherein the means for engagement is constituted by a kerf in the solid outer end of the cylindrical element.

7. A disposable plug assembly according to claim 1 which includes a separate plastic filler plug adapted to fit in the upper portion of the cavity and shaped to cooperate with the main cylindrical element in filling at least the outer portion of said core cylinder cavity.

8. A disposable plug assembly according to claim 7 wherein the filler plug has a cylindrical body provided with a longitudinal recess arcuately profiled on a radius equal to the radius of the lower portion of the cavity.

* * * * *